US012427365B2

(12) United States Patent
Pineda, III

(10) Patent No.: US 12,427,365 B2
(45) Date of Patent: Sep. 30, 2025

(54) MULTI-PURPOSE EXERCISE APPARATUS FOR GROUP THERAPY

(71) Applicant: Carlos Pena Pineda, III, Lakewood, CA (US)

(72) Inventor: Carlos Pena Pineda, III, Lakewood, CA (US)

( * ) Notice: Subject to any disclaimer, the term of this patent is extended or adjusted under 35 U.S.C. 154(b) by 121 days.

(21) Appl. No.: 18/437,057

(22) Filed: Feb. 8, 2024

(65) Prior Publication Data

US 2024/0316396 A1 Sep. 26, 2024

Related U.S. Application Data

(60) Provisional application No. 63/454,672, filed on Mar. 25, 2023.

(51) Int. Cl.
*A63B 21/00* (2006.01)
*A63B 17/04* (2006.01)

(52) U.S. Cl.
CPC ..... *A63B 21/4035* (2015.10); *A63B 17/04* (2013.01); *A63B 2225/10* (2013.01)

(58) Field of Classification Search
CPC ... A63B 2009/006; A63B 17/00; A63B 17/04; A63B 21/00047; A63B 21/0442; A63B 21/0552; A63B 21/16; A63B 21/4035; A63B 23/1209; A63B 26/00; A63B 26/003; A63B 71/0009; A63B 2071/0018; A63B 2225/09; A63B 2225/093; A63B 2225/10; A63B 2225/105; A63B 2225/107
See application file for complete search history.

(56) References Cited

U.S. PATENT DOCUMENTS 4,241,914 A * 12/1980 Bushnell ..... A63B 21/00181 482/130
5,013,035 A * 5/1991 Nathaniel ..... A63B 23/03533 482/129
9,320,955 B2 * 4/2016 Aral Diaz ..... E06C 1/32
11,865,398 B1 * 1/2024 Parvarandeh ..... A63B 22/0605
2007/0032357 A1 * 2/2007 Piane ..... A63B 69/222 482/142

(Continued)

FOREIGN PATENT DOCUMENTS

FR 2845613 A1 * 4/2004 ..... A63B 9/00

*Primary Examiner* — Gary D Urbiel Goldner
(74) *Attorney, Agent, or Firm* — Heedong Chae; Lucem, PC

(57) ABSTRACT

A multi-purpose exercise apparatus for group therapy includes a plurality of side frames. At least one of the side frames includes a first horizontal bar, a second horizontal bar, a third horizontal bar, and first and second vertical bars. The second horizontal bar is positioned above the first horizontal bar, and the third horizontal bar is positioned above the second horizontal bar. Each side frame accommodates a user, enabling the exercise apparatus to accommodate multiple users simultaneously. The plurality of the side frames are constructed to form a closed polygonal frame. The closed polygonal frame may be shaped as a triangle, rectangle, square, pentagon, hexagon, octagon, or other polygon. In an alternative embodiment, the plurality of the side frames may form an unclosed polygon to allow a trainer or instructor to enter the unclosed polygon through an open side.

9 Claims, 17 Drawing Sheets

10

10′

(56) References Cited

U.S. PATENT DOCUMENTS

| | | | | |
|---|---|---|---|---|
| 2009/0072111 | A1* | 3/2009 | Piane, Jr. | A63B 69/222<br>248/309.1 |
| 2011/0053738 | A1* | 3/2011 | Osbourne | A63B 21/4019<br>482/122 |
| 2011/0237410 | A1* | 9/2011 | Perez | A63B 21/0442<br>482/129 |
| 2013/0095983 | A1* | 4/2013 | Manfre | A63B 22/00<br>482/91 |
| 2013/0213917 | A1* | 8/2013 | Rios Garcia Prieto | A63B 17/00<br>211/182 |
| 2014/0135183 | A1* | 5/2014 | Inglut | A63B 23/1227<br>482/96 |
| 2016/0023035 | A1* | 1/2016 | Meyer | A63B 1/00<br>482/38 |
| 2018/0028852 | A1* | 2/2018 | Beaver | A63B 71/0036 |
| 2018/0243597 | A1* | 8/2018 | Schlegel | A63B 23/047 |
| 2019/0388721 | A1* | 12/2019 | Schlegel | A63B 69/34 |
| 2023/0114752 | A1* | 4/2023 | Dery | A63B 21/16<br>482/148 |

* cited by examiner

10'

MULTI-PURPOSE EXERCISE APPARATUS FOR GROUP THERAPY

CROSS-REFERENCE TO RELATED APPLICATIONS

This application claims priority to U.S. Provisional Patent Application No. 63/454,672, filed on Mar. 25, 2023, which is incorporated herein by reference in its entirety.

FIELD OF THE INVENTION

The present invention pertains to a multi-purpose exercise device designed for group therapy sessions. It comprises multiple side frames that are configured to connect together and form a closed polygonal structure, accommodating multiple users simultaneously. The exercise apparatus is equipped with a variety of components including horizontal bars, a table, a horizontal line marker, a hook, a rotating carousel, a base plate, etc. These elements are integrated to facilitate a diverse range of exercises, making the apparatus suitable for physical therapy, occupational therapy, and other exercise-related applications.

Background of the Invention

Older adults and individuals with lower limb conditions require assessment of their lower limb function and targeted exercises to enhance their condition. The seated step test is one such assessment tool that helps therapists and healthcare professionals evaluate lower limb function. During this test, individuals remain seated, placing their feet flat on the floor, and then step onto a platform, typically 6-12 inches high, with one foot at a time in an alternating manner, all while maintaining a seated posture.

To improve lower limb conditions, flexibility exercises, including stretching and range-of-motion exercises, are crucial. These exercises enhance joint flexibility and muscle strength, promote proper joint movement, and alleviate stiffness.

However, current solutions often involve separate assessment tools and exercise equipment, which can be bulky and space-consuming. Moreover, most exercise or therapy equipment is designed for individual use, with or without a therapist's or trainer's assistance.

Furthermore, in occupational/physical therapy clinics, the space needed to accommodate equipment and patients may be limited. While patients may exercise individually, it may be beneficial in certain cases for multiple patients to exercise concurrently, e.g., for group therapy, and/or to be monitored by a single therapist. As such, there is a need for an improved exercise system that meets the above-mentioned requirements.

To address these issues, a multi-purpose exercise apparatus tailored for group therapy sessions is provided. This innovative apparatus combines lower limb function assessment tools with various exercise options suitable for group settings, effectively addressing the identified needs and challenges.

SUMMARY OF THE INVENTION

The present invention contrives to solve the disadvantages of the prior art. The present invention provides a multi-purpose exercise device designed for group therapy sessions.

The object of the present invention is to provide a multi-purpose exercise apparatus for group therapy, which includes a plurality of side frames. At least one of the side frames includes a first horizontal bar, a second horizontal bar, a third horizontal bar, and first and second vertical bars. The second horizontal bar is positioned above the first horizontal bar, and the third horizontal bar is positioned above the second horizontal bar. Each side frame accommodates a user, enabling the exercise apparatus to accommodate multiple users simultaneously. The plurality of the side frames are constructed to form a closed polygonal frame. The closed polygonal frame may be shaped as a triangle, rectangle, square, pentagon, hexagon, octagon, or other polygon. In the alternative embodiment, the plurality of the side frames may form an unclosed polygon to allow a trainer or instructor to enter the unclosed polygon through the open side.

The exercise apparatus is further equipped with a variety of components including horizontal bars, a table, a horizontal line marker, a hook, a rotating carousel, a base plate, etc. These elements are integrated to facilitate a diverse range of exercises.

Another object of the present invention is to provide a multi-purpose exercise apparatus for group therapy, which includes a horizontal bar and a vertical support. The horizontal bar has a plurality of sides and the vertical support supports the horizontal bar. The horizontal bar having the plurality of sides is constructed to accommodate a plurality of users simultaneously. The plurality of sides are constructed to form a closed polygonal frame, and the vertical support comprises a plurality of vertical bars that support the horizontal bar, respectively being connected to vertices of the closed polygonal frame.

Still another object of the present invention is to provide a multi-purpose exercise apparatus for group therapy, which includes a first horizontal bar, a second horizontal bar, a third horizontal bar, and a plurality of vertical bars. The first, second, and third horizontal bars are parallel to each other, and the first, second, and third horizontal bars are respectively constructed to form a closed polygonal frame to accommodate multiple users simultaneously. The plurality of vertical bars 150' support the first, second, and third horizontal bars, respectively being connected to vertices of the closed polygonal frame. The closed polygonal frame may be shaped as a triangle, rectangle, square, pentagon, hexagon, octagon, or other polygon. Alternatively, one side of the frame may be open so that therapist or trainer can enter the frame.

The advantages of the present invention are: (1) the exercise apparatus of the present invention has a modular structure of side frames which allow for easy assembly and disassembly, making it highly adaptable to different spaces and therapy session requirements; (2) by combining assessment tools with exercise equipment, the exercise apparatus of the present invention serves a dual purpose, facilitating both the evaluation of lower limb function and the performance of targeted exercises and reducing the need for multiple pieces of equipment; (3) the exercise apparatus of the present invention encourages group therapy sessions, allowing multiple patients to exercise simultaneously under the supervision of a single therapist; (4) with various components like horizontal bars, a rotating carousel, and a base plate, the apparatus supports a wide range of exercises, catering to different therapeutic needs; and (5) the polygonal frame structure allows for compact group sessions, making efficient use of limited clinic space.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value.

Similarly, when values are expressed as approximations, by use of the antecedent "about", it will be understood that the particular value forms another embodiment.

Figure 1A:
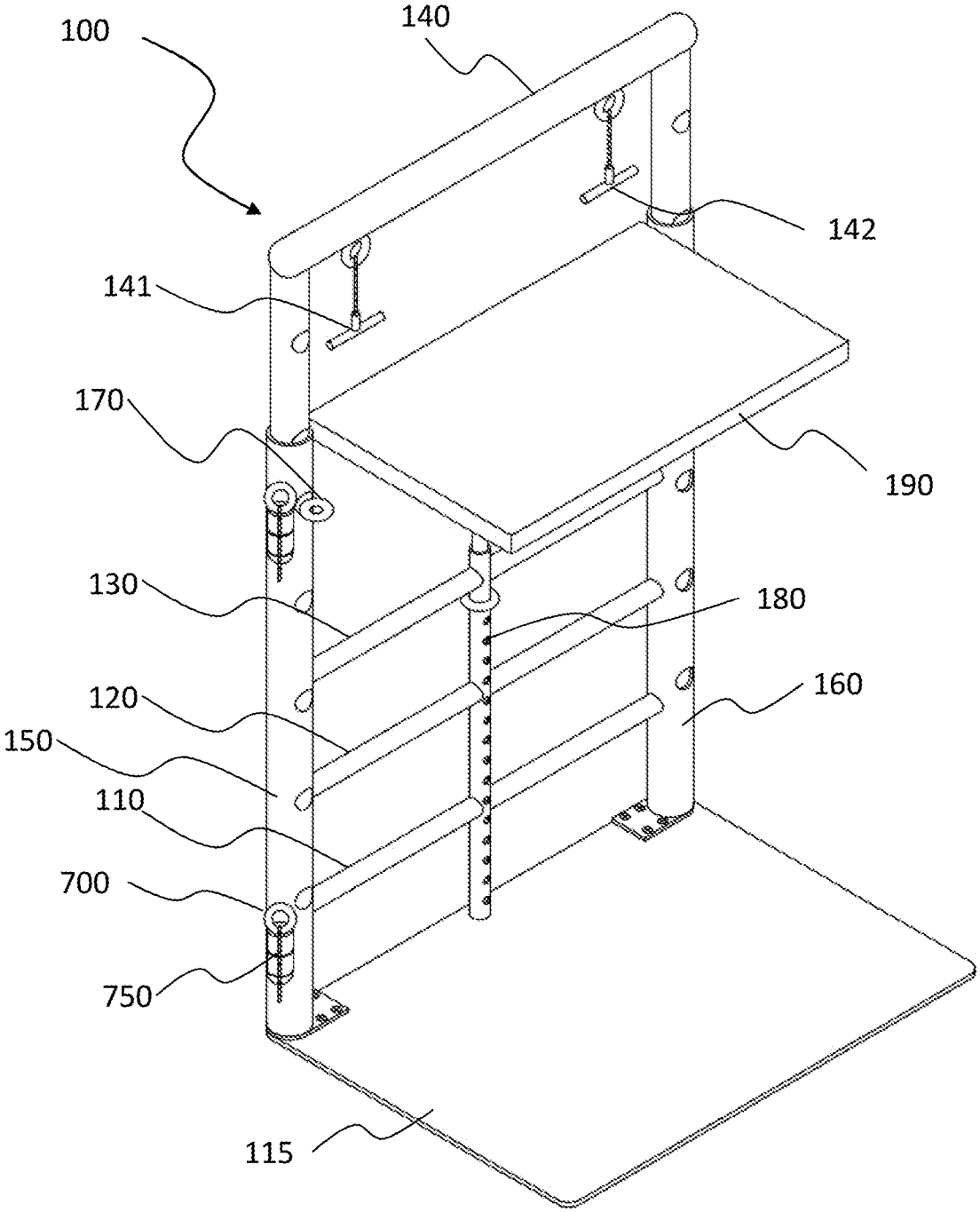
FIG. 1A shows a perspective view of a side frame according to the present invention.
Figure 1B:
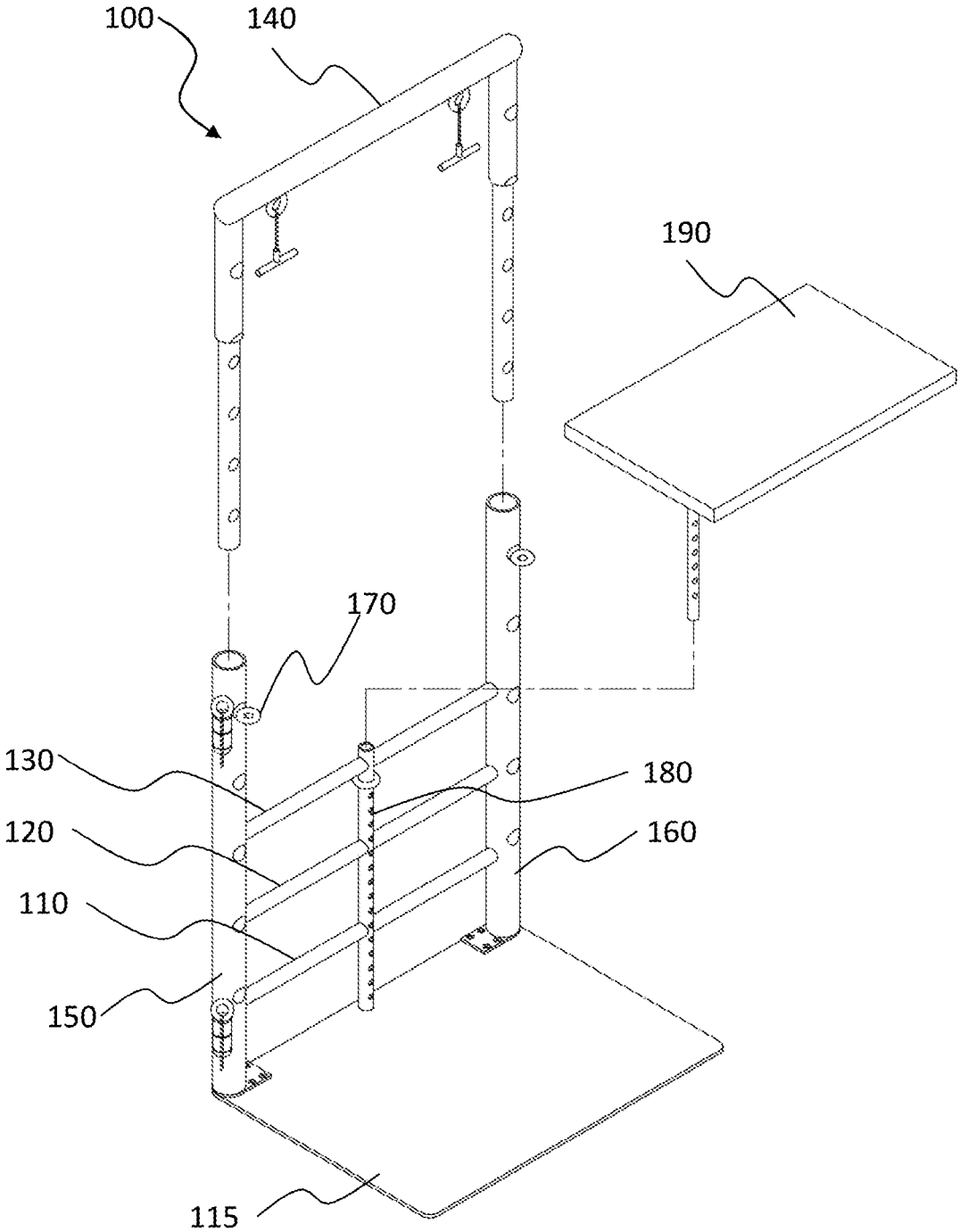
FIG. 1B shows an exploded view of the side frame according to the present invention.
Figure 2A:
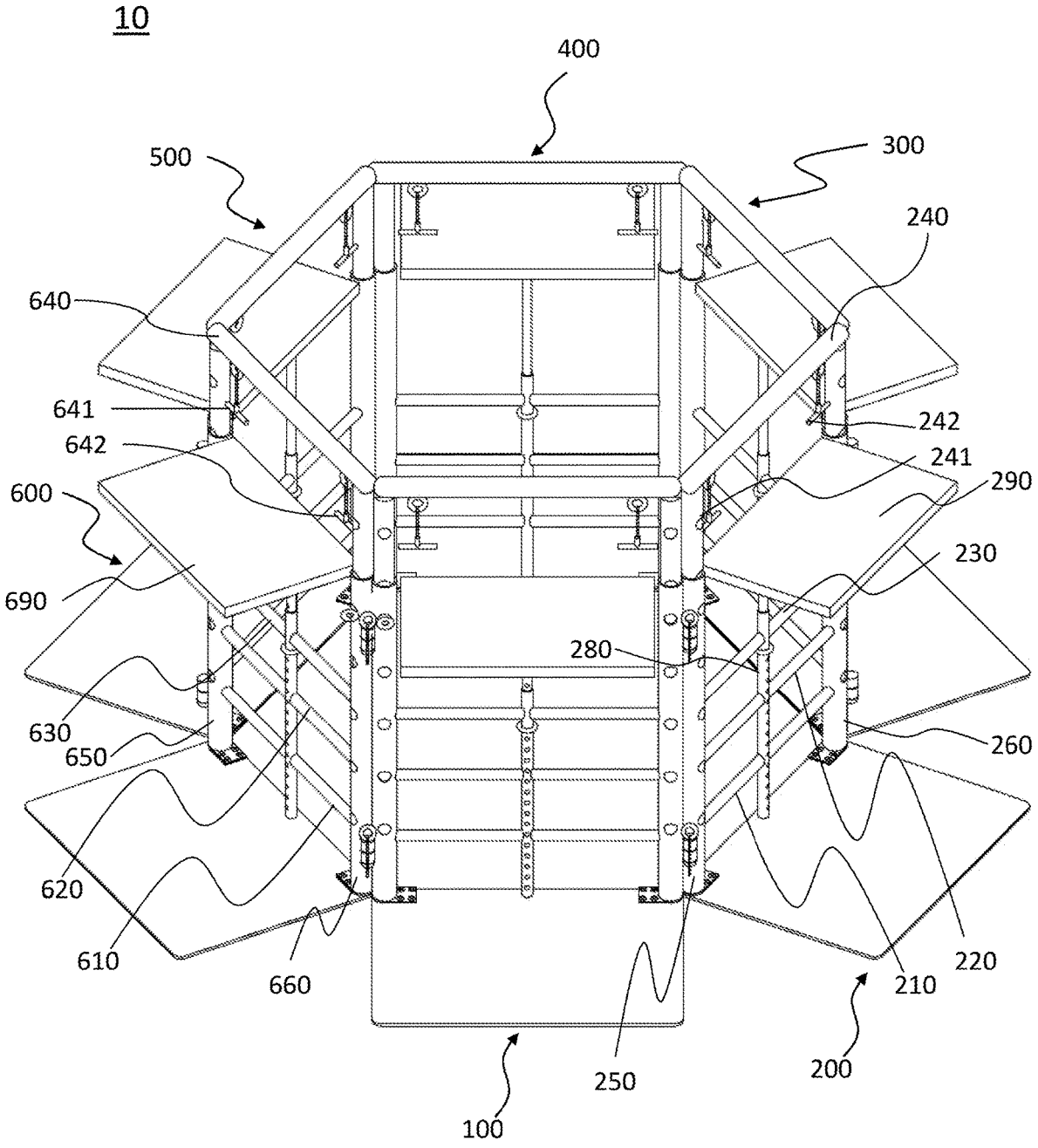
FIGS. 2A, 2B, and 2C show a multi-purpose exercise apparatus for group therapy in the form of hexagon according to the present invention.
Figure 2B:
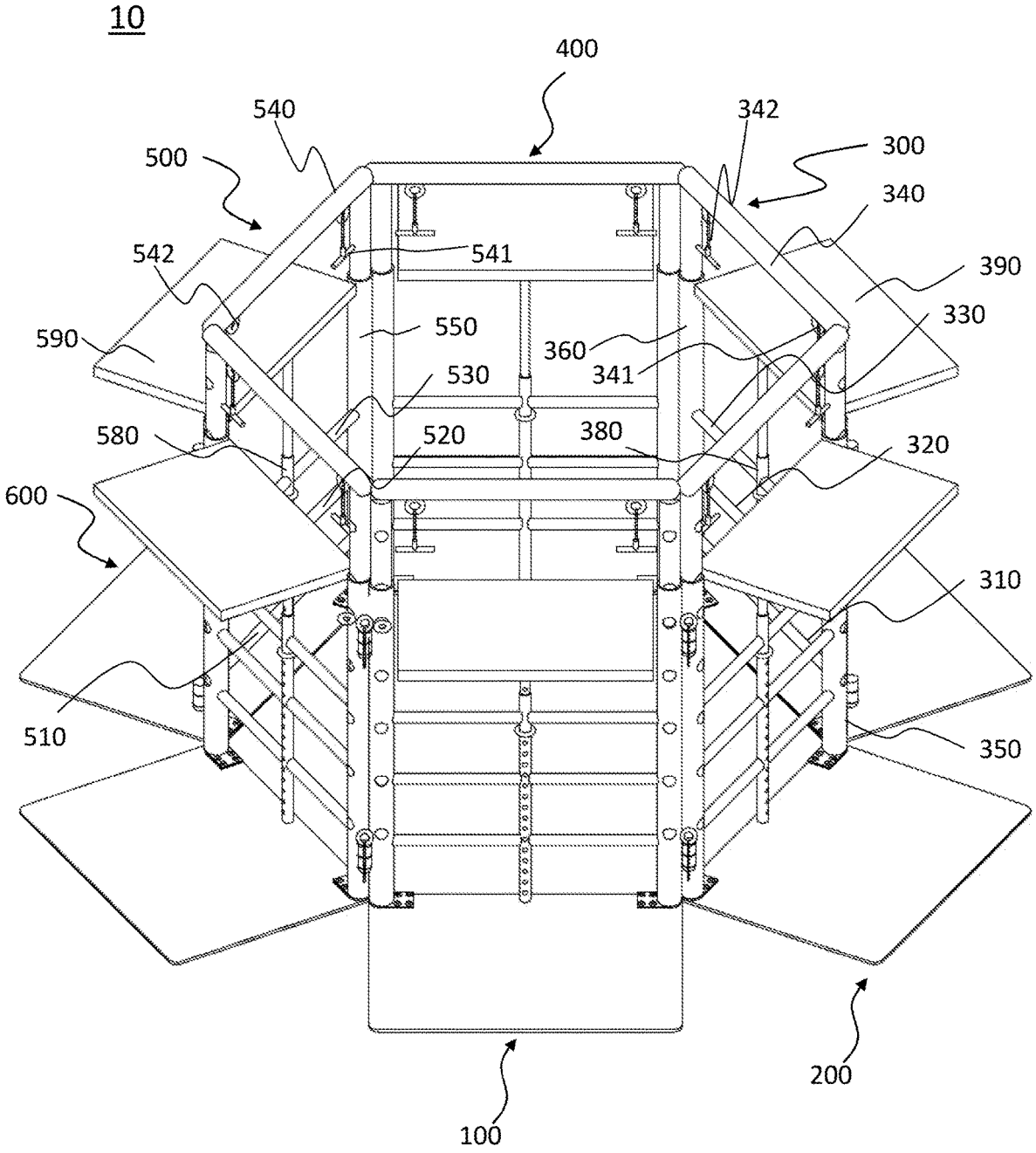
Figure 2C:
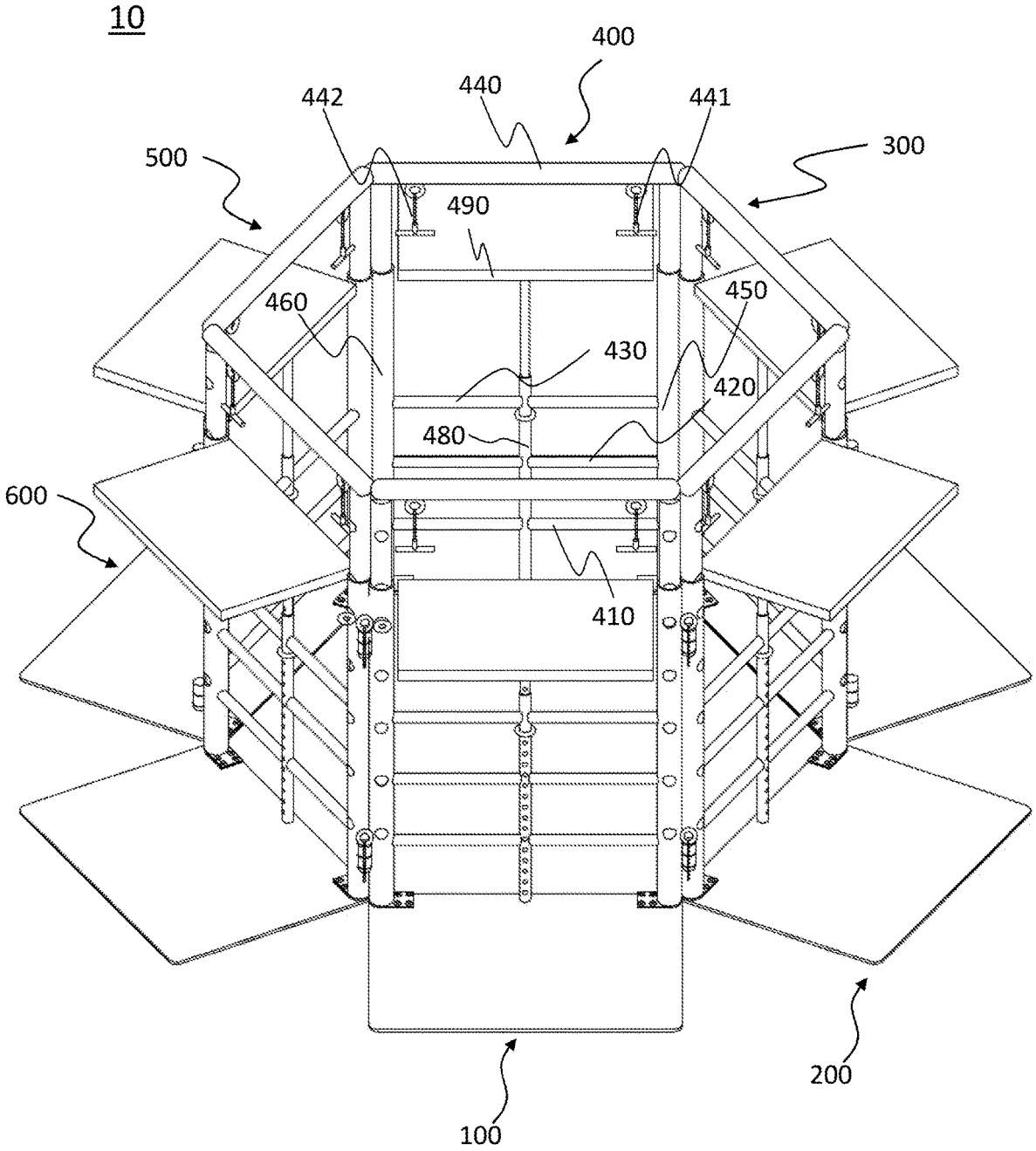

FIGS. 1A and 1B show perspective and exploded views of a side frame 100, in accordance with one embodiment 10 of the present invention. FIGS. 2A, 2B, 2C, 5, and 8 show perspective, top, and front elevational views of a multi-purpose exercise apparatus 10 for group therapy shaped as a hexagon according to the present invention. The multi-purpose exercise apparatus 10 for group therapy comprises a plurality of side frames 100, 200, 300, 400, 500, 600, and at least one 100 of the side frames comprises a first horizontal bar 110, a second horizontal bar 120, a third horizontal bar 130, and first and second vertical bars 150, 160. The second horizontal bar 120 is positioned above the first horizontal bar 110, and the third horizontal bar 130 is positioned above the second horizontal bar 120. Furthermore, the first and second vertical bars 150, 160 support the first, second, and third horizontal bars 110, 120, 130, being connected to both ends of first, second, and third horizontal bars 110, 120, 130. The first, second, and third horizontal bars 110, 120, 130 are parallel to each other. Moreover, each side frame 100, 200, 300, 400, 500, 600 accommodates a user, enabling the exercise apparatus 10 to accommodate multiple users simultaneously. Preferably, there are three horizontal bars on the bottom. The first horizontal bar 110 is 6 inches from the floor; the second horizontal bar 120 is 12 inches from the floor; and the third horizontal bar 130 is 18 inches from the floor.

Preferably, as shown in FIG. 2, each side frame 100, 200, 300, 400, 500, 600 may have the first, second, and third horizontal bars 110, 210, 310, 410, 510, 610, 120, 220, 320, 420, 520, 620, 130, 230, 330, 430, 530, 630, and the first and second vertical bars 150, 250, 350, 450, 550, 650, 160, 260, 360, 460, 560, 660. In addition, for each of the side frames, the first and second vertical bars support the first, second, and third horizontal bars, being connected to both ends of first, second, and third horizontal bars. Moreover, the plurality of the side frames 100, 200, 300, 400, 500, 600 are constructed to assemble into a closed polygonal frame. This closed polygonal frame can take various shapes, including a triangle, rectangle, square, pentagon, hexagon, octagon, or other polygon. In an alternative embodiment, the plurality of the side frames may form an open polygon, providing an entry point for a trainer or instructor. In still alternative embodiment, the side frames 100, 200, 300, 400, 500, 600 may be constructed to allow formation of various closed or unclosed polygons.

While the apparatus is usable by individuals, it's primarily designed for simultaneous use by multiple people, either individually or in a group setting. This makes it especially useful for group therapy sessions or in occupational/physical therapy clinics where space or the number of therapists might be limited. The apparatus's polygonal design creates distinct spaces for users to exercise close to each other without interference, enabling a single therapist to oversee multiple clients effectively, thereby facilitating group exercises.

The polygonal configuration of the apparatus defines a distinct space for each individual to exercise, and allows multiple individuals to exercise in relative proximity to one another but without encroaching on one another's space. Furthermore, the relative proximity of the individuals exercising enables a single therapist to monitor multiple individuals at once and is further conducive to group exercise.

In certain embodiments, the height of the horizontal bars is precisely calibrated for use both as an assessment and treatment tool. The apparatus further provides opportunities for many add on options, which may be utilized both for assessments and treatment procedures.

According to one embodiment, the exercise apparatus may be in the form of a hexagon, providing 6 sides that can accommodate 6 individuals. Such apparatus may comprise tubular metal bars. Each bar may be approximately 1.5 inches in diameter, with the horizontal bars being approximately 36 inches in length and the vertical bars being approximately 4 feet long. Additionally, each side of the hexagon may include a first horizontal bar at approximately floor level, a second horizontal bar about 6 inches above the first bar, a third horizontal bar about 12 inches above the second bar, a fourth horizontal bar about 18 inches above the third bar, and a ceiling bar at the top end of the structure.

One such assessment for aerobic capacity is known as the "Seated Step Test." This test is designed for an individual that cannot assume a standing position and may still be recovering from a medical condition. The patient can be seated in a wheelchair or on a comfortable chair to perform aerobic exercise in a group or individual setting. A metronome can be used to challenge the patient's aerobic capacity, strength, and power. Another type of validated standardized test which utilizes the vertical bars on each hexagon vertex is known as the "2-minute step test". In this test, marking (s) are placed on the vertical bar based on the patient's measurement, and the patient may perform Aerobic exercises in a group or individual mode of therapy.

The present invention incorporates features that facilitate these assessments, enhancing its utility for therapeutic and rehabilitative purposes.

Figure 3:
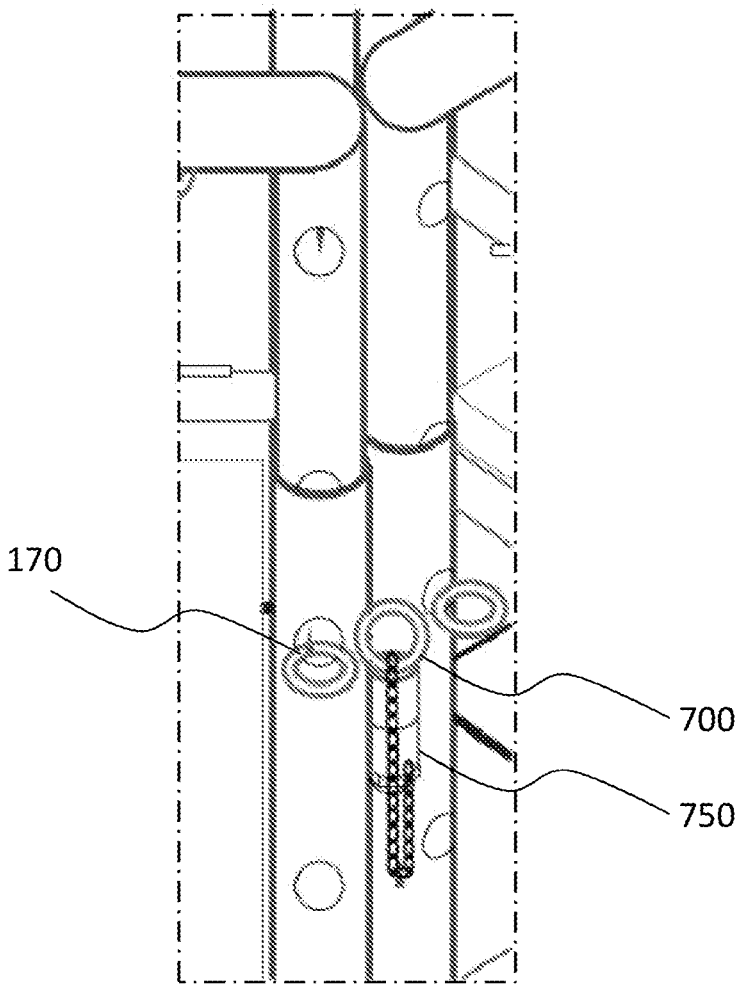
FIG. 3 shows an enlarged view of a loose pin which joins adjacent vertical bars according to the present invention.
Figure 10:
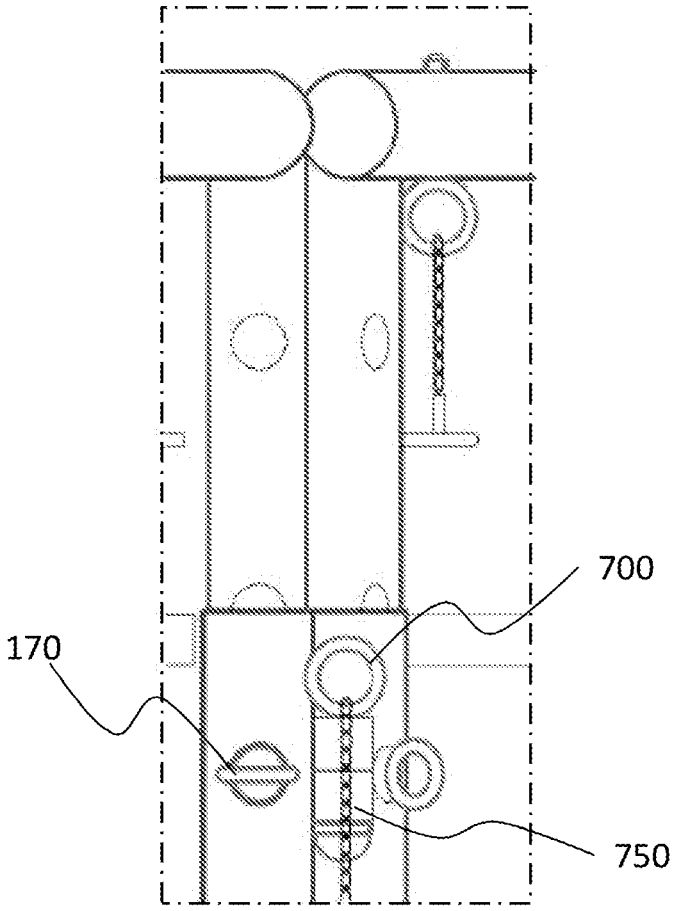
FIG. 10 shows another enlarged view from FIG. 8, showing the horizontal line marker and the top loose pin.
Figure 11:
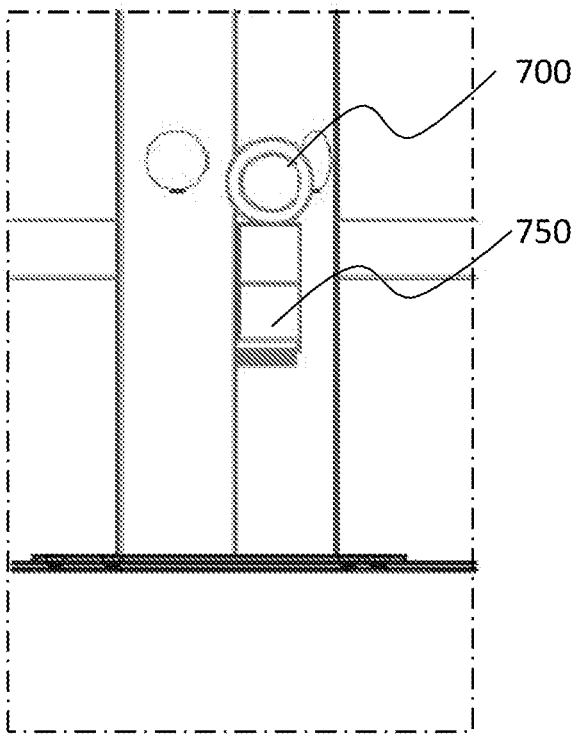
FIG. 11 shows another enlarged view from FIG. 8, showing the bottom loose pin.

FIG. 3 shows an enlarged view of a loose pin 700 which joins adjacent vertical bars 160, 250 according to the present invention. FIGS. 10 and 11 show enlarged views from FIG. 8, respectively showing the top and bottom loose pins 700.

In one embodiment, adjacent side frames, such as frames 100 and 200, are constructed to be interconnected by a hinge 50 and a loose pin 700, which couple adjacent vertical bars, for instance bars 160 and 250, of the adjacent side frames 100, 200.

The adjacent side frames 100, 200 are constructed to have interlocking hinges 750 which are joined by the loose pin 700. Preferably, there are two loose pins 700, and the loose pin 700 may have a threaded section for enhanced connection.

Moreover, each side frames 100, 200, 300, 400, 500, 600 further may include a top horizontal bar 140, 240, 340, 440, 540, 640 which is positioned above the third horizontal bar 130, 230, 330, 430, 530, 630, such that the top horizontal bars of the side frames form a continuous and closed polygon at uniform heights. In the alternative embodiment, the top horizontal bars may form an unclosed polygon. Moreover, the top horizontal bars of the side frames are constructed to adjust their heights as shown in FIG. 10 where a vertical bar downwardly extending from the top horizontal bar 140 is height-adjustably received in the second vertical bar 160, and fastened at a desired position. For each side frame, the top horizontal bar is vertically adjustable to a minimum of 32 inches from the floor and a maximum of 40 inches from the floor.

Figure 8:
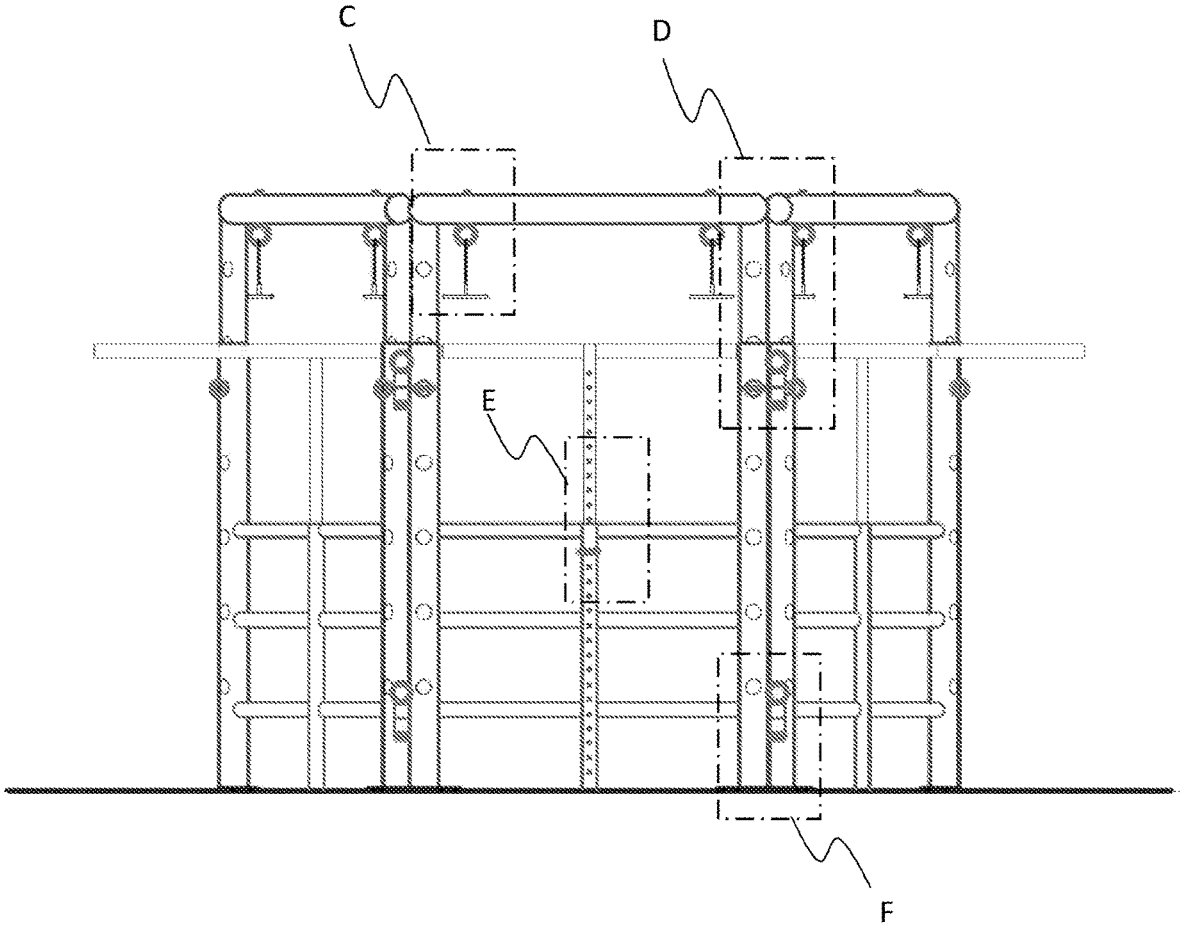
FIG. 8 shows a front elevational view of the multi-purpose exercise apparatus for group therapy in the form of hexagon according to the present invention.
Figure 9:
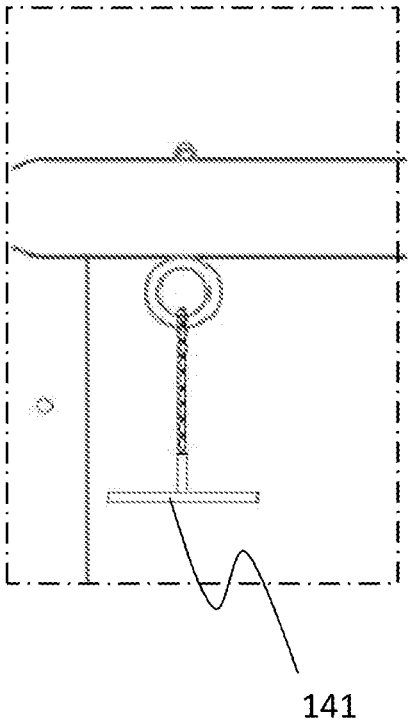
FIG. 9 shows an enlarged view from FIG. 8, showing the horizontal line marker.

FIG. 9 shows an enlarged view from FIG. 8, showing the horizontal line marker 141, and FIG. 10 shows another enlarged view from FIG. 8, showing the horizontal line marker 141 and the loose pin 700. The multi-purpose exercise 10 further includes a horizontal line marker 141, 142 which is substantially horizontal and parallel to the top horizontal bar 140. As shown in the figures, the horizontal line marker 141, 142 is suspended from the top horizontal bar 140 and its height is adjustable.

Preferably, each top horizontal bar 140 is equipped with two detachable horizontal line markers 141, 142, used in gait and aerobic capacity training. The line markers 141, 142 serve as visual cues for the desired height of knee lifts during in-place marching or gait exercises, aiding in the improvement of knee and hip flexion throughout the gait cycle's swing phase. Patients can walk around the apparatus along a continuous path, holding onto any of the top horizontal bars 140, 240, 340, 440, 540, 640 facilitated by the apparatus's hexagonal design, which supports uninterrupted movement. The inverted T-shaped rods 141, 142, provide visual and tactile feedback during standardized tests and exercises aimed at enhancing gait, strength, and aerobic capacity. The attached chains to these rods are adjustable to suit various exercises and patient needs.

The side frame 100 may further include a hook 170 to retain a resistance band (not shown). This hook 170 can be conveniently attached at multiple heights on either or both vertical bars 150, 160, enhancing the frame's adaptability for a range of exercises. The round, height-adjustable hook 170 can be positioned at various levels, starting from 5 inches above the floor and increasing in 5-inch increments, up to a maximum height of 30 inches. This feature allows for the precise positioning of resistance bands to target specific muscle groups, particularly beneficial for exercises aimed at strengthening the shoulder's rotator muscles and facilitating neuromuscular reeducation through diagonal movements and midline crossing activities. The detailed marking system on the vertical bars assists in setting the correct height for exercises targeting both the upper and lower extremities, supporting the development of proprioceptive neuromuscular patterns.

Figure 12:
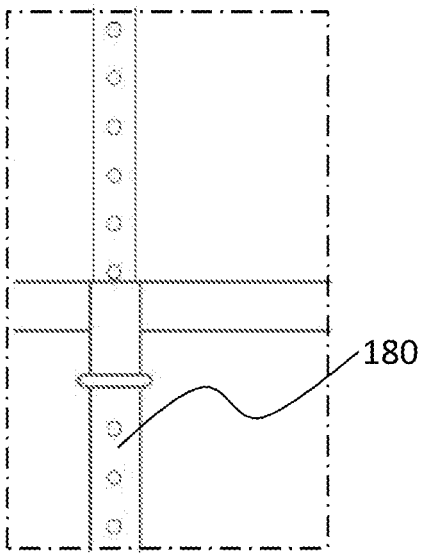
FIG. 12 shows another enlarged view from FIG. 8, showing the middle vertical bar.

FIG. 12 shows another enlarged view from FIG. 8, showing the middle vertical bar 180. The side frame 100 may further include a middle vertical bar 180 that connects approximately at midpoints of the first, second, and third horizontal bars 110, 120, 130 to enhance the frame's stability and functionality. In addition, the side frame 100 may further include a detachable table 190, which can be securely attached to the middle vertical bar 180, serving as its support column. This table 190, measuring 12 inches by 20 inches, offers height adjustability ranging from 25 to 30 inches above the floor, making it versatile for various therapeutic and activity-based uses, such as fine motor control exercises, tabletop activities, and self-feeding tasks.

Figure 6:
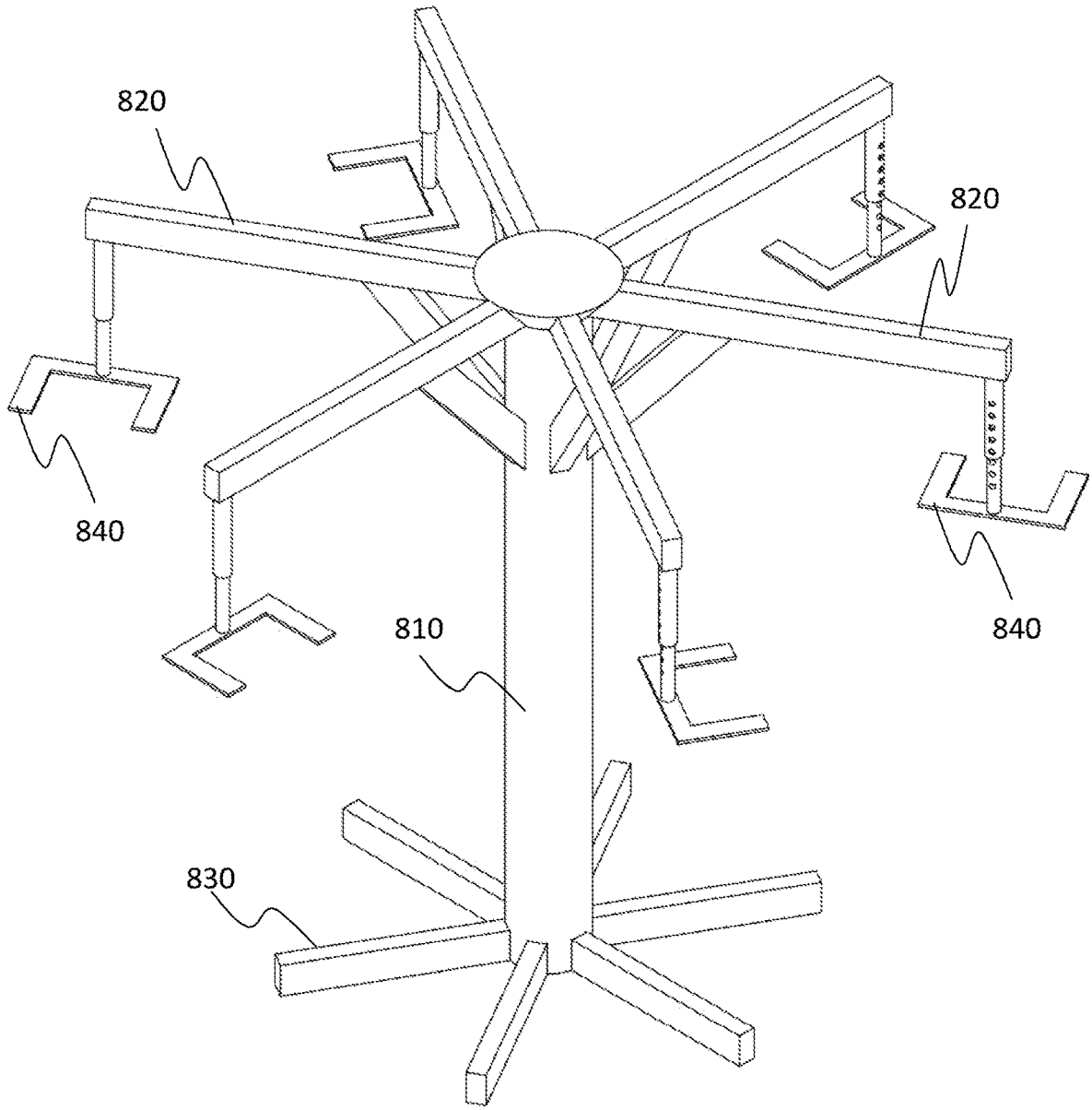
FIG. 6 shows a perspective view of a rotating carousel of the multi-purpose exercise apparatus according to the present invention, illustrating six arms.
Figure 7:
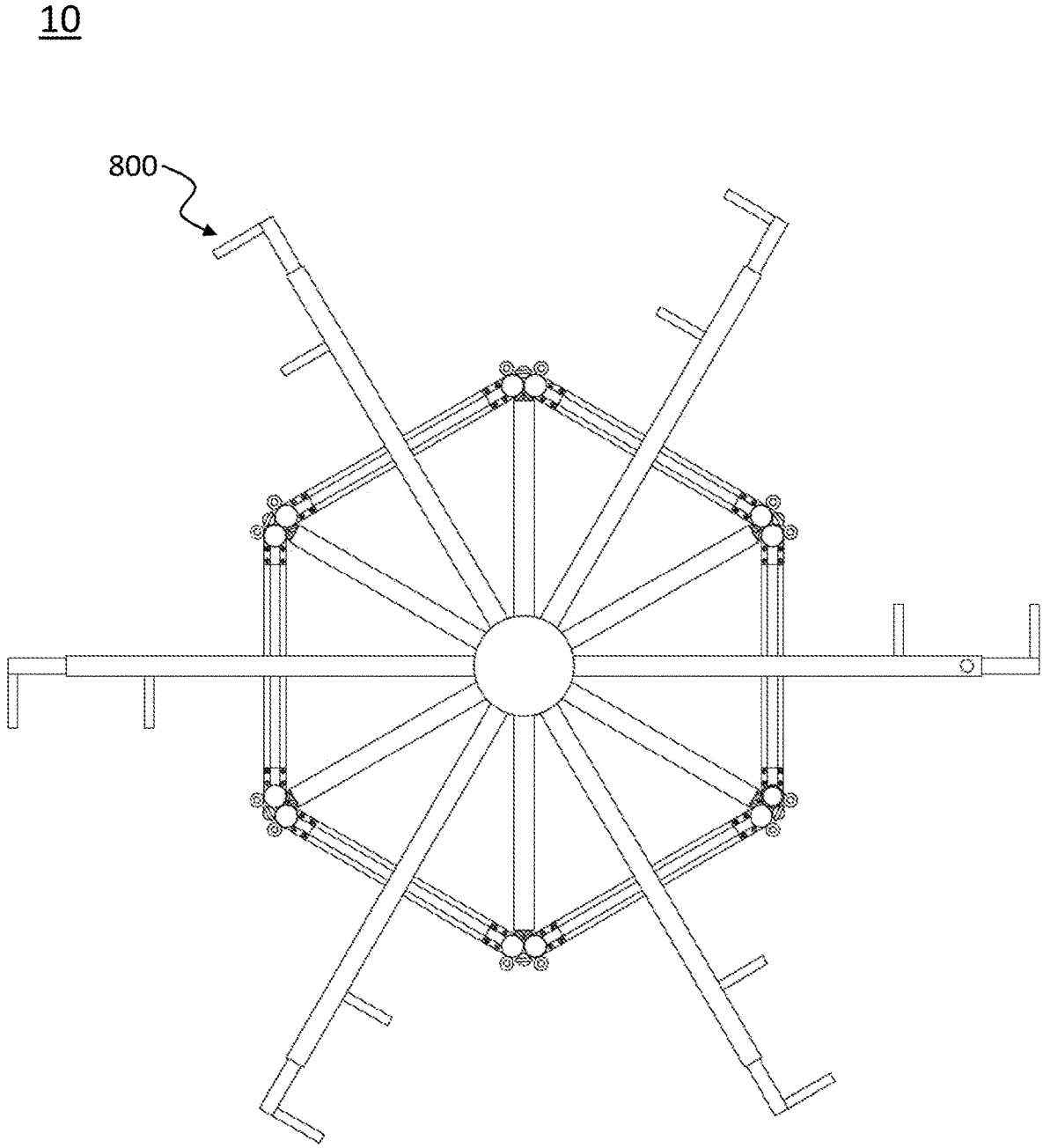
FIG. 7 shows a top view of the rotating carousel according to the present invention.

FIG. 6 shows a perspective view of a rotating carousel 800 of the multi-purpose exercise apparatus 10 according to the present invention, illustrating six arms 820, and FIG. 7 shows a top view of the rotating carousel 800.

In one embodiment, the multi-purpose exercise apparatus 10 may further comprise a detachable rotating carousel 800, positioned centrally within the hexagon. The carousel 800 may have a projected pair of handlebars 840 on each side of the hexagon 820, offering support to individuals as they walk around the hexagon. The rotating carousel 800 may be configured to rotate in both directions, enabling exercises such as backward walking, suitable for both group and individual therapy sessions.

The rotating carousel 800 includes a center post 810 that is positioned about a center of the closed polygonal frame; a plurality of arms 820 which outwardly extend about from a top end of the center post 810 beyond the side frames 100, 200, 300, 400, 500, 600; a plurality of legs 830 which extend from a bottom end of the center post 810 and is connected to the first and second vertical bars 160:250, 260:350, 360:450, 460:550, 560:650, 660:150; and a "U"-shaped handle 840 that is attached to an end of the arm 820.

The rotating carousel 800 can be installed within the polygonal frame, with its handle 840 extending outward. This handle 840 is telescoping, allowing adjustment to accommodate various user heights. The carousel 800 is capable of rotating in both directions-clockwise and counterclockwise-making it an effective tool for gait training in group therapy sessions. It facilitates safe practice of backward walking exercises. The 'U'-shaped handle 840 is ingeniously designed to telescope downward from the arm 820, enhancing the carousel's functionality and user accessibility.

Figure 4:
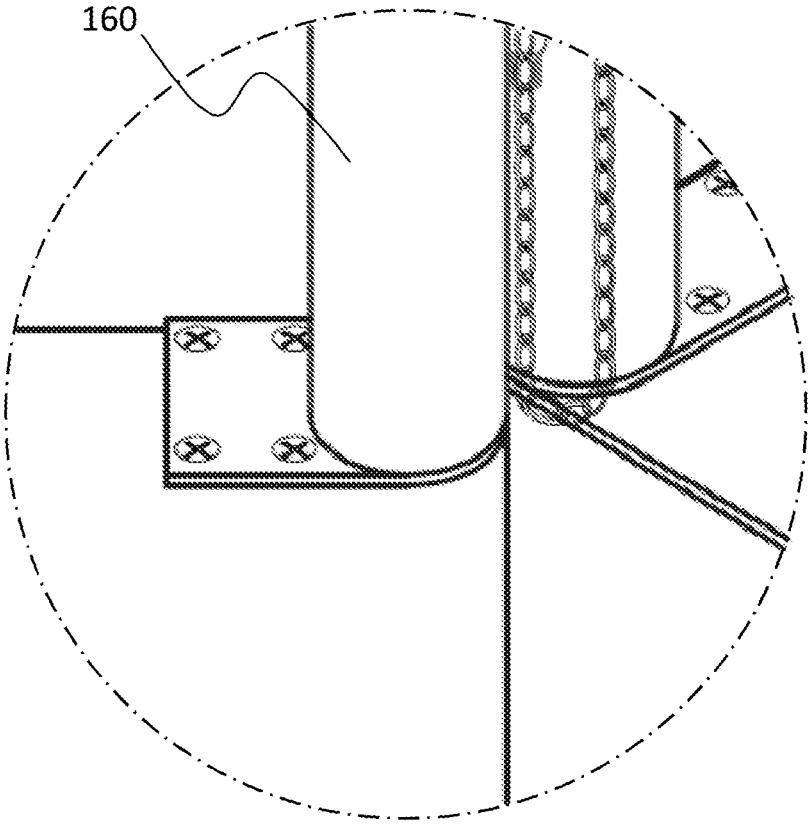
FIG. 4 shows a base plate that is attached to the vertical plate according to the present invention.
Figure 5:
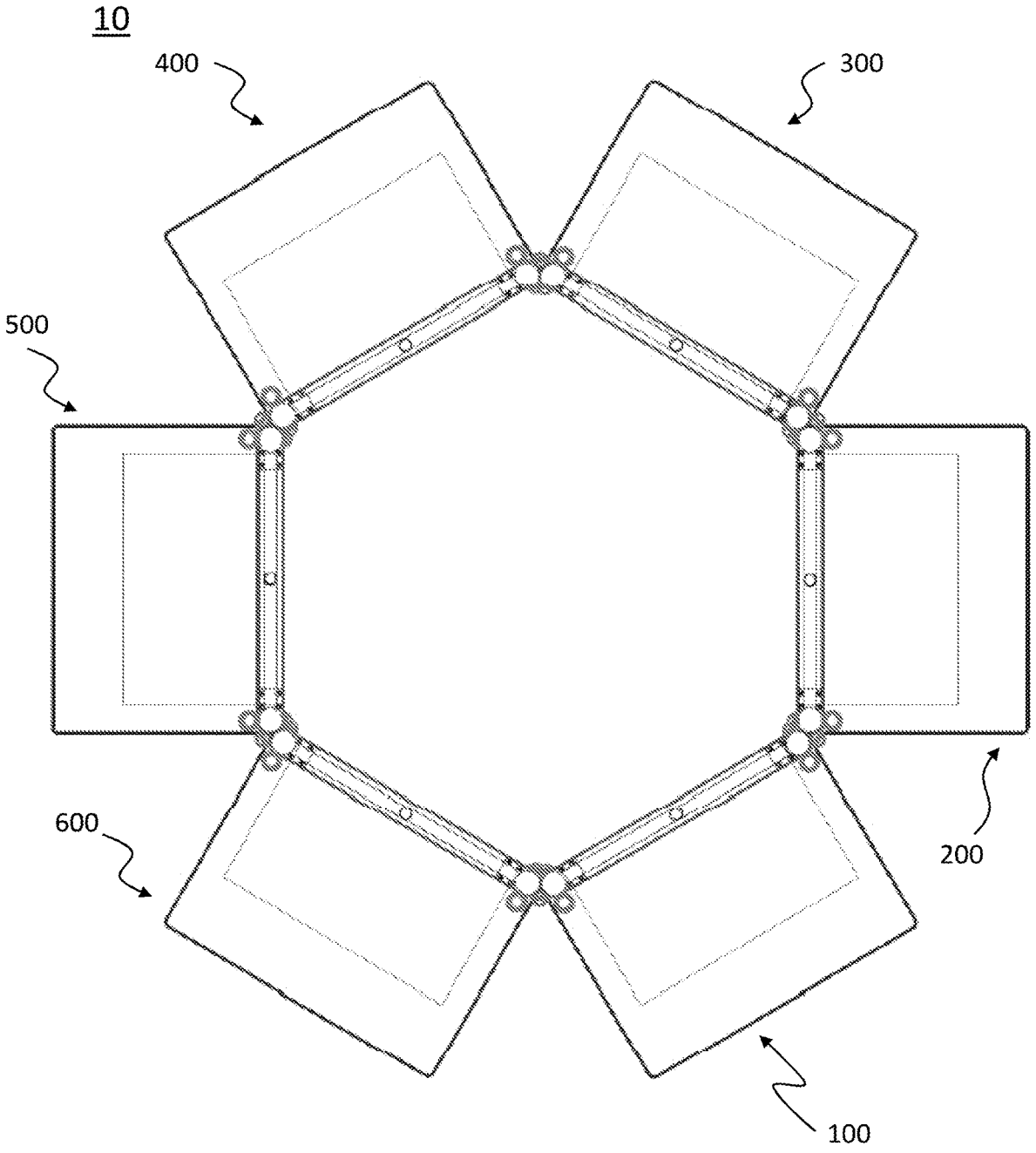
FIG. 5 shows a top view of the multi-purpose exercise apparatus for group therapy in the form of hexagon according to the present invention.

FIG. 4 shows a base plate 115 that is attached to the vertical plate 150, 160. The side frame 100 may further comprise a base plate 115 that is attached to the first and second vertical bars 150, 160. The base plate 115 is designed to enhance the stability of the apparatus, labeled 10, during operation. When a patient stands on the base plate 115, their body weight acts as a stabilizing anchor, ensuring added safety. Additionally, the base plate 115 serves as a platform for various balance training tools, such as balance pads and footprints, aiding in exercises like the 4-stage balance test that reinforce the patient's foundational support. Furthermore, the base plate may feature numerical or color-coded markings, providing a means to engage and challenge the patient's cognitive skills while participating in diverse therapeutic activities.

In a preferred embodiment, the first and second vertical bars 150, 160 and the top horizontal bar 140 are made of tubular stainless steel with 2 inches in diameter. The first, second, and third horizontal bars 110, 120, 130 are also made of tubular stainless steel with 1 inch in diameter with the structural reinforcement by the middle vertical bar 180.

Figure 13:
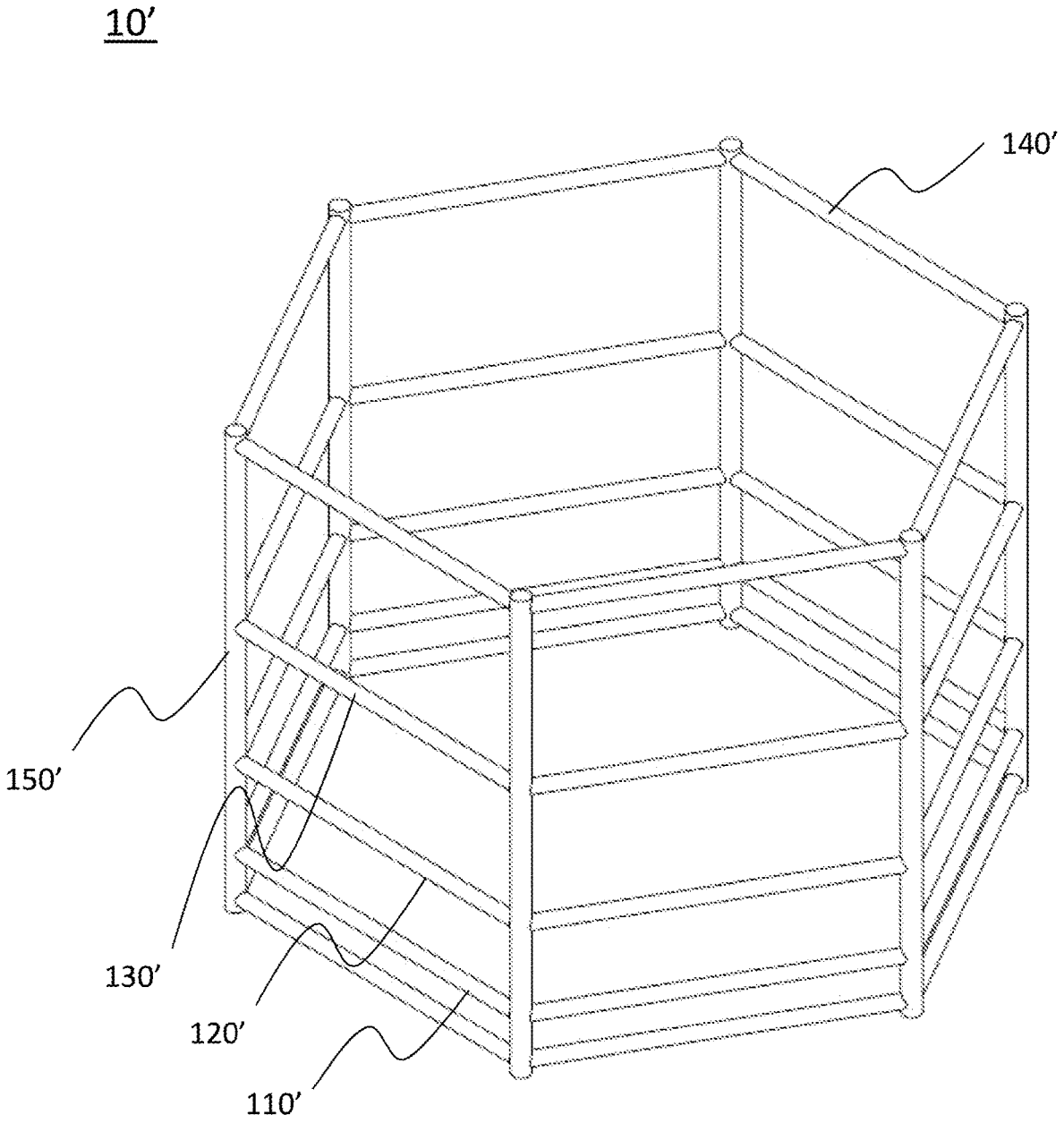
FIG. 13 shows a perspective view of the multi-purpose exercise apparatus for group therapy in the form of hexagon according to another embodiment of the present invention.
Figure 14:
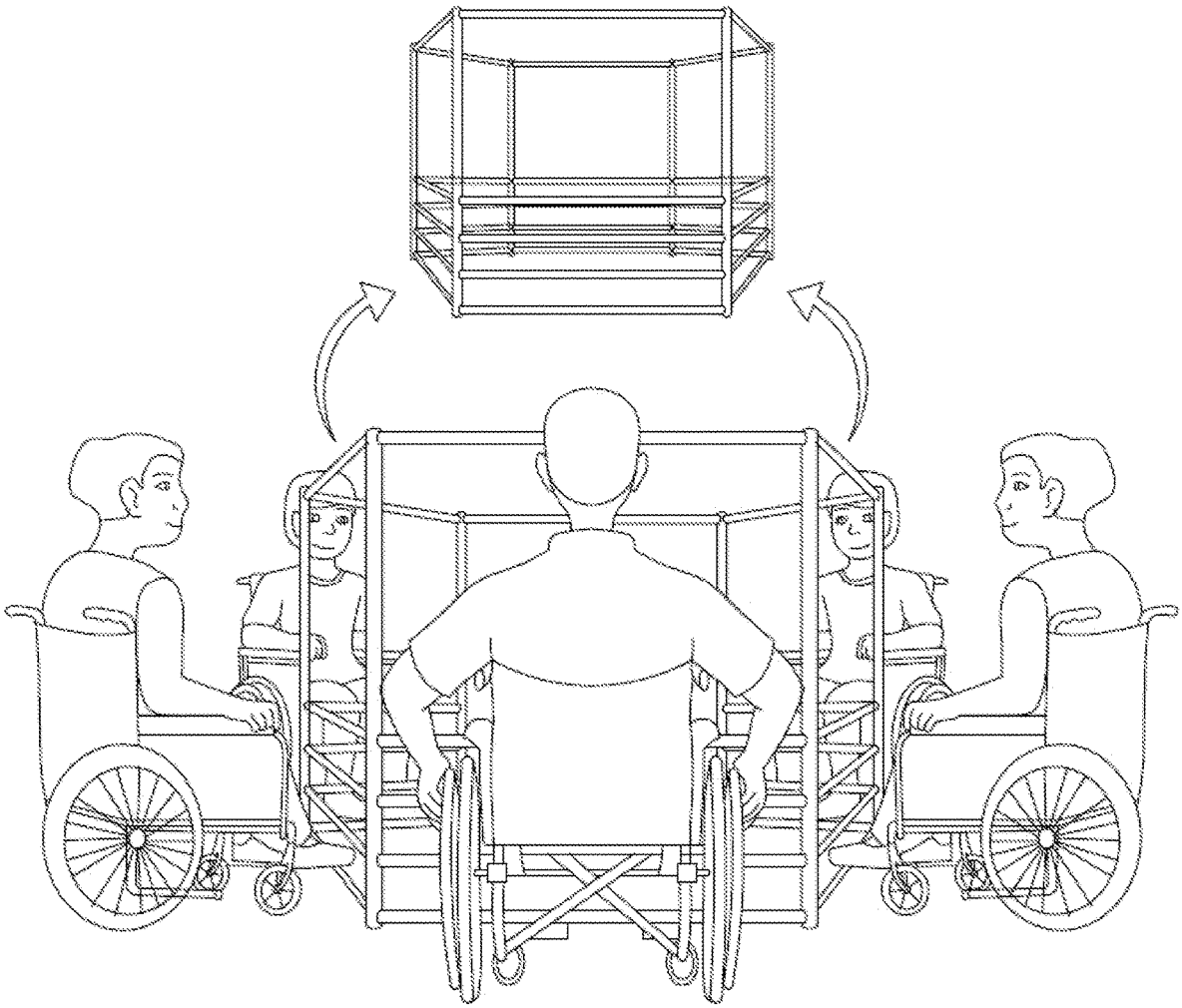
FIG. 14 shows an illustrative view of a group of people exercising together using the multi-purpose exercise apparatus according to the present invention.

FIG. 13 shows a perspective view of the multi-purpose exercise apparatus 10' for group therapy in the form of hexagon according to another embodiment of the present invention, and FIG. 14 shows an illustrative view of a group of people exercising together using the multi-purpose exercise apparatus 10' according to the present invention.

In the alternative embodiment of the present invention, the multi-purpose exercise apparatus 10, 10' for group therapy may include a horizontal bar 110, 110' that has a plurality of sides; and a vertical support 150, 150' that supports the horizontal bar. The horizontal bar 110, 110' having the plurality of sides is constructed to accommodate a plurality of users simultaneously.

The plurality of sides are constructed to form a closed polygonal frame, and the vertical support 150, 150' comprises a plurality of vertical bars that support the horizontal bar, respectively being connected to vertices of the closed polygonal frame.

In addition, the multi-purpose exercise apparatus 10, 10' may further include a top horizontal bar 140, 140' that is positioned above the horizontal bar 110, 110' and connected to the plurality of vertical bars 150, 150'. The top horizontal bar 110, 110' forms a continuous and closed polygon with the same heights, and the top horizontal bar 140, 140' is constructed to adjust its height from the plurality of vertical bars 150, 150'. The multi-purpose exercise apparatus 10, 10' may further include a horizontal line marker 141 which is substantially horizontal and parallel to the top horizontal bar 140. The horizontal line marker 141 is suspended from the top horizontal bar 140 and its height is adjustable.

Still in the alternative embodiment of the present invention, the multi-purpose exercise apparatus 10' for group therapy includes a first horizontal bar 110'; a second horizontal bar 120', which is positioned above the first horizontal bar 110'; a third horizontal bar 130', which is positioned above the second horizontal bar 120'; and a plurality of vertical bars 150'. The first, second, and third horizontal bars 110', 120', 130' are parallel to each other, and the first, second, and third horizontal bars 110', 120', 130' are respectively constructed to form a closed polygonal frame to accommodate multiple users simultaneously. The plurality of vertical bars 150' support the first, second, and third horizontal bars 110', 120', 130', respectively being connected to vertices of the closed polygonal frame. The closed polygonal frame may be shaped as a triangle, rectangle, square, pentagon, hexagon, octagon, or other polygon. Alternatively, one side of the frame may be open so that therapist or trainer can enter the frame.

The multi-purpose exercise apparatus 10' may further include a top horizontal bar 140' which is positioned above the third horizontal bar 130' and parallel to the third horizontal bar 130', such that the top horizontal bar 140' forms the closed polygonal frame. The top horizontal bar 140' is constructed to adjust its height from the plurality of vertical bars 150'.

In addition, the multi-purpose exercise apparatus 10' may further comprise a horizontal line marker 141, 142 (not shown in FIG. 13) which is substantially horizontal and parallel to the top horizontal bar 140'. The horizontal line marker 141, 142 is suspended from the top horizontal bar 140' and its height is adjustable.

The multi-purpose exercise apparatus 10' may further include a hook 170 (not shown in FIG. 13) to retain a resistance band (not shown) wherein the vertical bar 150' is constructed for the hook 170 to be detachably attached at various heights on the vertical bar 150'.

The apparatus features multiple horizontal bars, accommodating a wide range of exercise routines for both non-ambulatory individuals using wheelchairs and ambulatory patients. It is designed to support one or more users under the guidance of a qualified professional, facilitating physiological enhancements conducive to health improvement. The equipment is also suitable for conducting standardized assessments. Moreover, it enables a variety of functional training exercises that can be performed either individually or in a group setting, fostering social interaction alongside physical rehabilitation.

It shall be appreciated that the disclosed apparatus may have different geometric shapes in alternate embodiments (e.g., square, pentagonal, triangular, octagonal, etc.), and need not necessarily be symmetrical. It shall be appreciated that any numbers of horizontal bars may be provided at various heights in alternate embodiments, and that each side need not necessarily include an equal number of horizontal bars and/or horizontal bars at equal vertical heights. It shall be appreciated that the apparatus may be configured in different sizes, and that more than one individual may use a side at the same time in alternate embodiments.

It shall be appreciated that the disclosed device and system can have multiple configurations in different embodiments, which may depend on factors such as the available area of a clinic, size and needs of the clienteles, user preferences, etc. It shall be appreciated that the device and system described herein may comprise any alternative known materials in the field and be of any size and/or dimensions. It shall be appreciated that the device may be manufactured and assembled using any known techniques in the field.

The device further provides a more practical means for a single therapist to monitor multiple patients for therapy and/or standardized testing, as well as providing a more practical means for a group mode of treatment.

While the invention has been shown and described with reference to different embodiments thereof, it will be appreciated by those skilled in the art that variations in form, detail, compositions and operation may be made without departing from the spirit and scope of the invention as defined by accompanying claims.

What is claimed is:

1. A multi-purpose exercise apparatus for group therapy, comprising:

a plurality of side frames, wherein each of the side frames comprises:

a first horizontal bar;

a second horizontal bar, which is positioned above the first horizontal bar;

a third horizontal bar, which is positioned above the second horizontal bar; and first and second vertical bars, which support the first, second, and third horizontal bars, being connected to opposing ends of the first, second, and third horizontal bars, wherein the first, second, and third horizontal bars are parallel to each other, wherein each of the plurality of side frames accommodates a user, enabling the exercise apparatus to accommodate multiple users simultaneously, and wherein the plurality of side frames are constructed to form a closed polygonal frame; and a rotating carousel comprising:

a center post which is positioned about a center of the closed polygonal frame;

a plurality of arms which outwardly extend about from a top end of the center post beyond the plurality of side frames;

a plurality of legs which extend from a bottom end of the center post and are respectively connected to each of the first and second vertical bars; and a "U"-shaped handle that is attached to an end of each of the plurality of arms.

2. The multi-purpose exercise apparatus of claim 1, wherein the closed polygonal frame is shaped as a triangle, rectangle, square, pentagon, hexagon, or octagon.

3. The multi-purpose exercise apparatus of claim 1, wherein adjacent side frames are constructed to be joined together by a loose pin, which couples adjacent vertical bars of the adjacent side frames.

4. The multi-purpose exercise apparatus of claim 1, wherein each of the side frames further comprises a top horizontal bar which is positioned above the third horizontal bar, such that the top horizontal bars of the plurality of side frames respectively form a continuous and closed polygon with same heights, and wherein the top horizontal bars of the plurality of side frames are respectively constructed to be height adjustable.

5. The multi-purpose exercise apparatus of claim 4, further comprising a horizontal line marker which is substantially horizontal and parallel to the top horizontal bar, and wherein the horizontal line marker is suspended from the top horizontal bar and a height of the horizontal line marker is adjustable.

6. The multi-purpose exercise apparatus of claim 1, wherein each side frame further comprises a hook to retain a resistance band wherein either or both of the first and second vertical bars are constructed for the hook to be detachably attached at various heights on either or both of the first and second vertical bars.

7. The multi-purpose exercise apparatus of claim 1, wherein each side frame further comprises a middle vertical bar that connects approximately at midpoints of the first, second, and third horizontal bars, and wherein each side frame further comprises a table which is constructed to be detachably attached to the middle vertical bar.

8. The multi-purpose exercise apparatus of claim 1, wherein each "U"-shaped handle is constructed to downwardly telescope from the corresponding arm.

9. The multi-purpose exercise apparatus of claim 1, wherein each side frame further comprises a base plate that is attached to the first and second vertical bars.

* * * * *